US005261550A

United States Patent [19]

Karpisek

[11] Patent Number: 5,261,550

[45] Date of Patent: Nov. 16, 1993

[54] CONTAINERS OF THE COLLAPSIBLE TYPE

[76] Inventor: Ladislav S. Karpisek, 86 Woodfield Boulevarde, Caringbah, New South Wales 2229, Australia

[21] Appl. No.: 842,140

[22] PCT Filed: Jul. 31, 1991

[86] PCT No.: PCT/AU91/00335

§ 371 Date: Mar. 2, 1992

§ 102(e) Date: Mar. 2, 1992

[87] PCT Pub. No.: WO92/02425

PCT Pub. Date: Feb. 20, 1992

[30] Foreign Application Priority Data

Aug. 1, 1990 [AU] Australia ..... PK1516
Nov. 9, 1990 [AU] Australia ..... PK3272

[51] Int. Cl.[5] ..... B65D 7/24
[52] U.S. Cl. ..... 220/4.33; 220/1.5
[58] Field of Search ..... 220/4.31, 4.32, 4.33, 220/1.5, 682; 217/12 R, 43 R

[56] References Cited

U.S. PATENT DOCUMENTS

| | | | |
|---|---|---|---|
| 3,156,370 | 11/1964 | Monfort | 220/4.33 X |
| 3,374,915 | 3/1968 | Verhein et al. | 220/4.33 X |
| 3,401,814 | 9/1968 | Chiswell et al. | 220/4.33 |
| 3,540,614 | 11/1970 | Flagg | 220/1.5 X |
| 3,760,970 | 9/1973 | Lutz | 220/4.33 X |
| 3,888,379 | 6/1975 | Folberth | 220/1.5 X |
| 4,020,967 | 5/1977 | Hammond et al. | 220/6 |
| 4,053,079 | 10/1977 | Karpisek | 220/1.5 X |
| 4,625,880 | 12/1986 | Pym | 220/1.5 X |

*Primary Examiner*—Steven M. Pollard
*Attorney, Agent, or Firm*—Edwin D. Schindler

[57] ABSTRACT

A collapsible container including a base (1), four interlockable demountable wall panels (12, 24) which are hooked to the base (1) by hook means (32) requiring vertical and then horizontal movement of each wall panel (12, 24) to connect the wall panel to the base (1), lateral support members (6, 7, 8, 9) on the four edges (2, 3, 4, 5) of the base (1) to relieve the hook means (32) from outwardly directed loads applied to the four interlocked panels (12, 24) by goods housed in the container.

9 Claims, 9 Drawing Sheets

Figure 8:
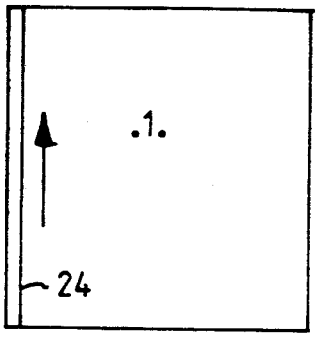

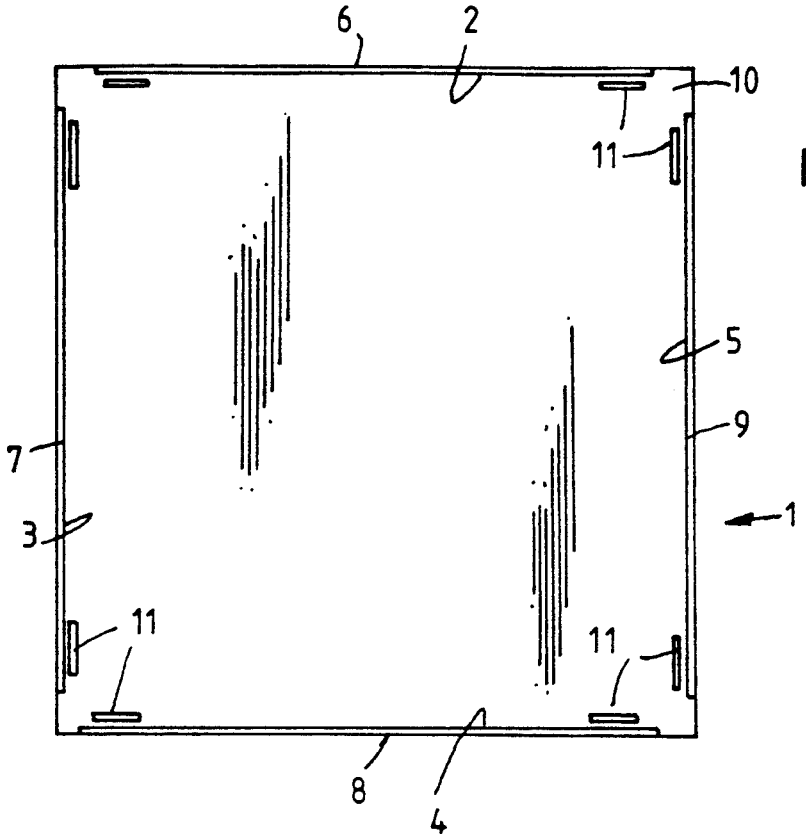
FIG. 1.
FIG. 4.
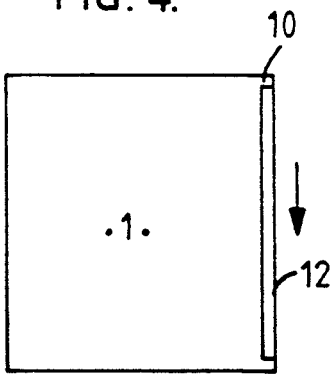
FIG. 5.
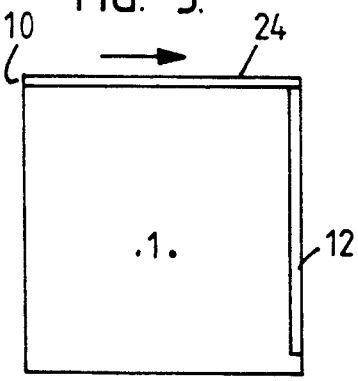
FIG. 6.
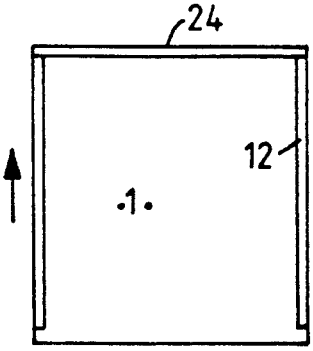
FIG. 7.
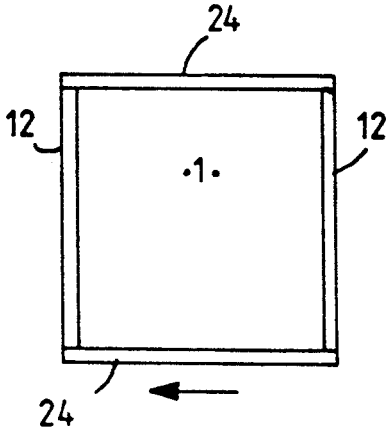

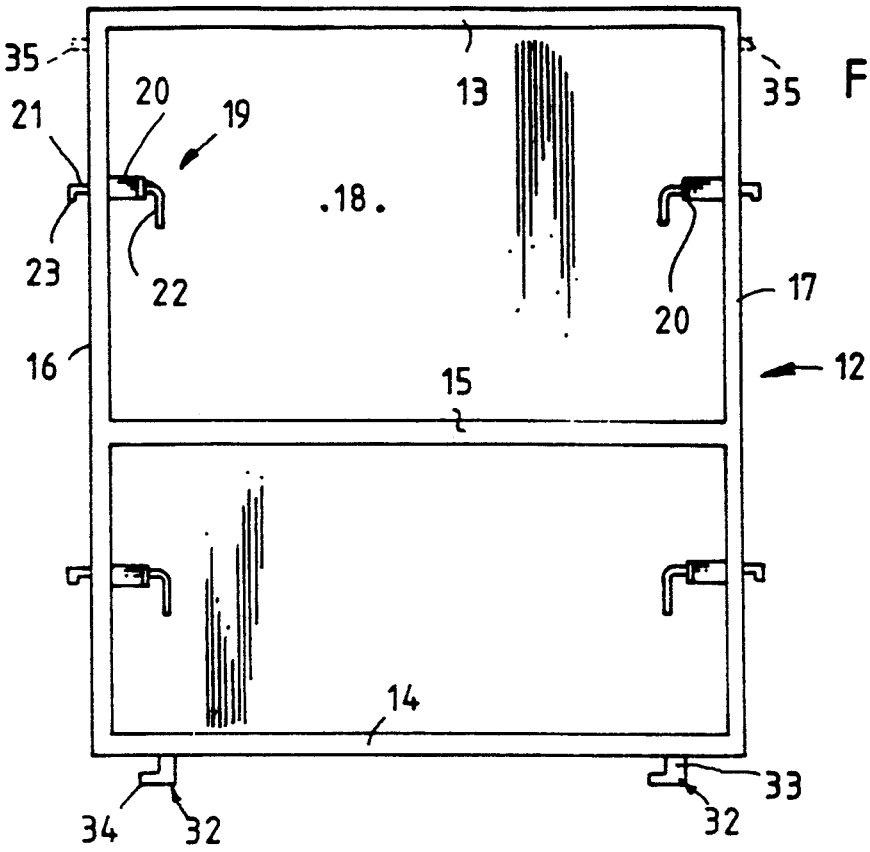
FIG. 2.
FIG. 3.
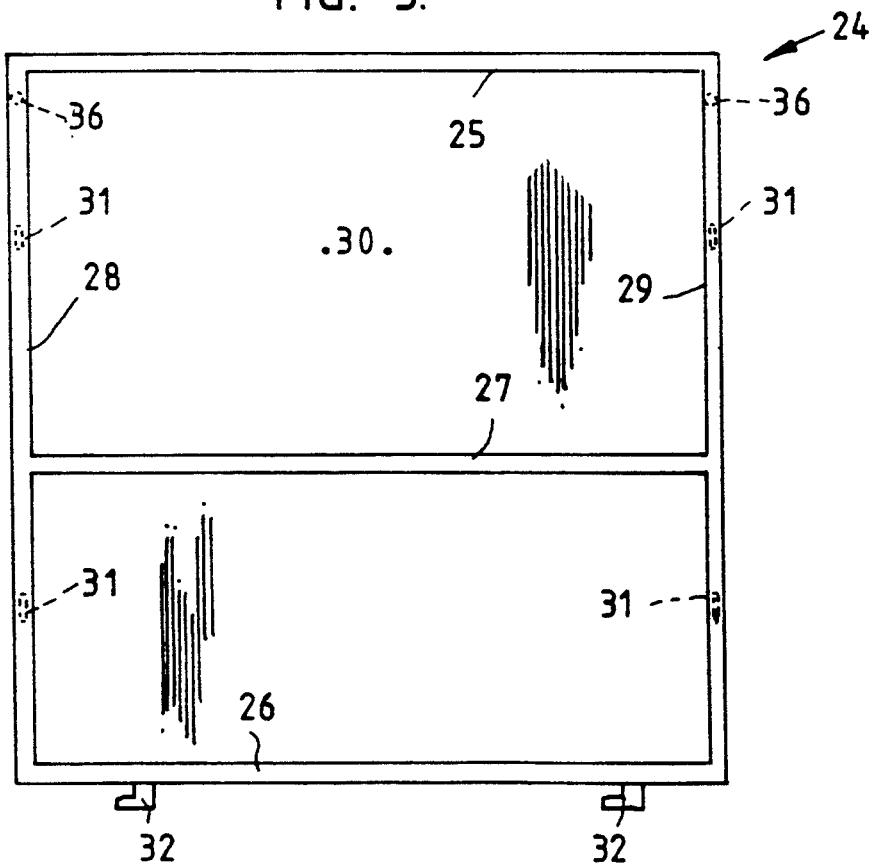

FIG. 31
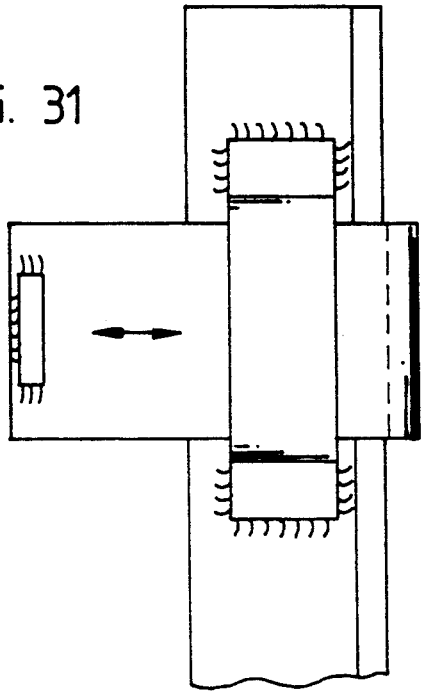
FIG. 32
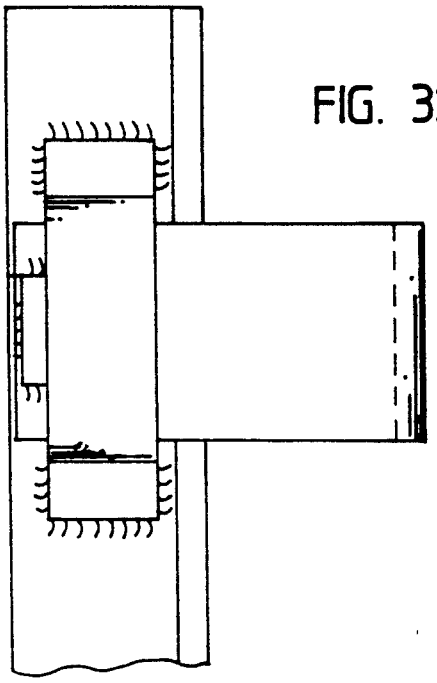
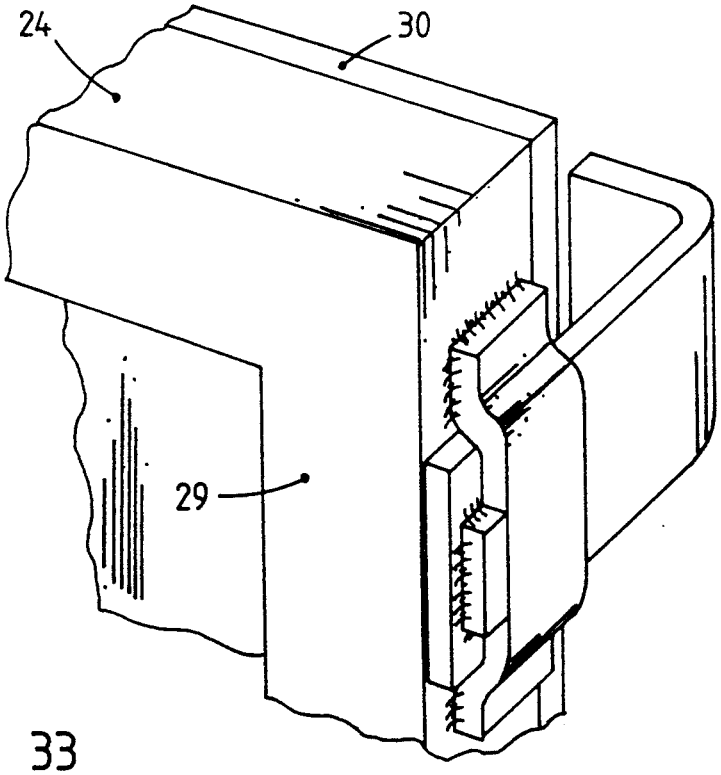
FIG. 33

CONTAINERS OF THE COLLAPSIBLE TYPE

This invention relates to containers of the type which includes as essential parts, a base, four sides which are demountably securable to the base so as to stand upright and coupling means to allow coupling of the sides together thereby to form a four sided enclosure. Preferably such containers also include a lid securable to the sides. Containers of the above type are presently known where the base is a pallet.

The above form of container when using a pallet as a base is frequently provided with a floor panel which acts as a support surface over the pallet battens for a liner bag of plastics material located within the enclosure. The liner bag can be used to house dry and wet goods and liquids. With containers as just described the connections of the sides to the pallet base have sometimes allowed movement between the sides and the base and the floor panel to the extent that the liner bag has been damaged. Where the container has been used for the transport of liquid leakage has sometimes occurred.

This invention advances the art of containers of the above type by overcoming at least the movement between component problem as outlined above thereby providing for better containers for the transport of liquid.

Broadly, the invention can be said to comprise a collapsible container including a base with four upstanding interlockable demountable wall panels which are hooked to the base by hook means requiring vertical and then horizontal movement of each wall panel to connect it to the base, lateral support members on the edges of the base relieve the hook means from outwardly directed loads applied by goods within the enclosure formed by the four wall panels.

More specifically, the invention can be said to comprise a collapsible container having a base of rectangular form providing a support surface, retaining means which upstand from the support surface and which extend along and lie adjacent each side of the base and terminate short of each corner of the base, apertures in said base inwardly of said retaining means and adjacent to the retaining means, two pairs of rectangular wall panels each panel having a top edge and a bottom edge and two side edges with the height of all panels between the top edge and the bottom edge being substantially the same and the side edge to side edge width of the panels of one pair being greater than the width of the panels of the other pair, a plurality of attachment means on bottom edge of each wall panel, the attachment means of each panel includes hooks each having a body part which extends away from the bottom edge of the panel and an elongated lateral lug where the lugs of a panel point in the same direction and are substantially parallel to the bottom edge of the panel and are in a common plane substantially parallel to the plane of the panel, the spacing of the attachment means of each panel corresponds with the spacing of the apertures of a side of the base and size of the apertures permits the attachment means to pass therethrough so the lugs thereof can hook under the base adjacent the apertures as a result of lateral movement of the panel relative to the base, releasable interconnecting means on the side edges of each panel so that when an enclosure is formed on the base by mounting the four panels thereon with the panels of each pair in opposed relationship and the side edges of the wider panels overlying the side edges of the narrower panels engagement of the interconnecting means locks the panels together to form an enclosure on the base with the adjacent side edges of the narrower and wider panels in parallel aligned relationship.

Figure 9:
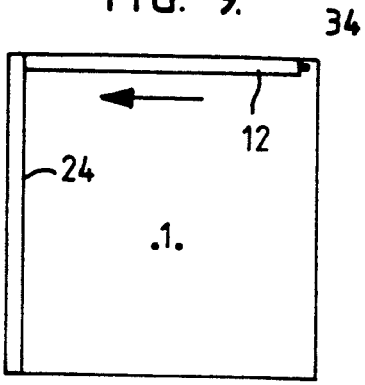
Figure 10:
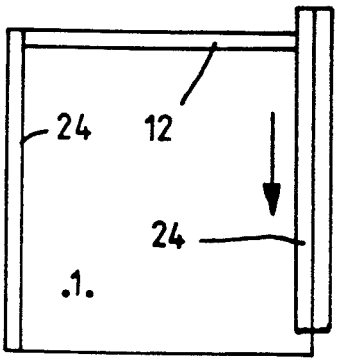
Figure 11:
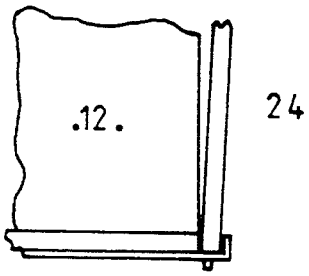
Figure 11:
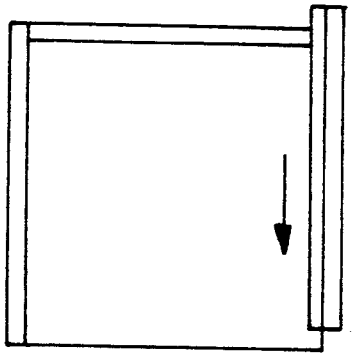
Figure 12:
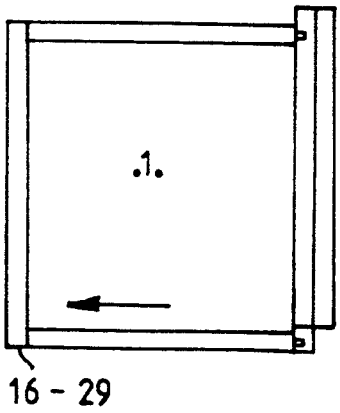
Figure 13:
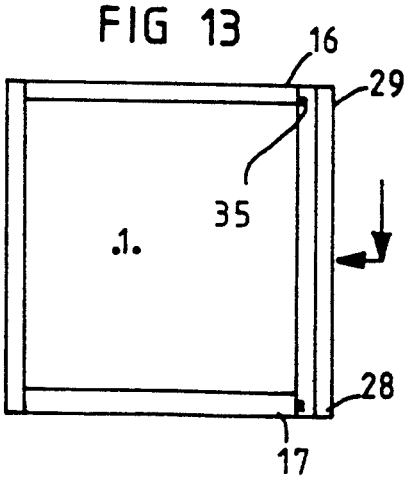
Figure 14:
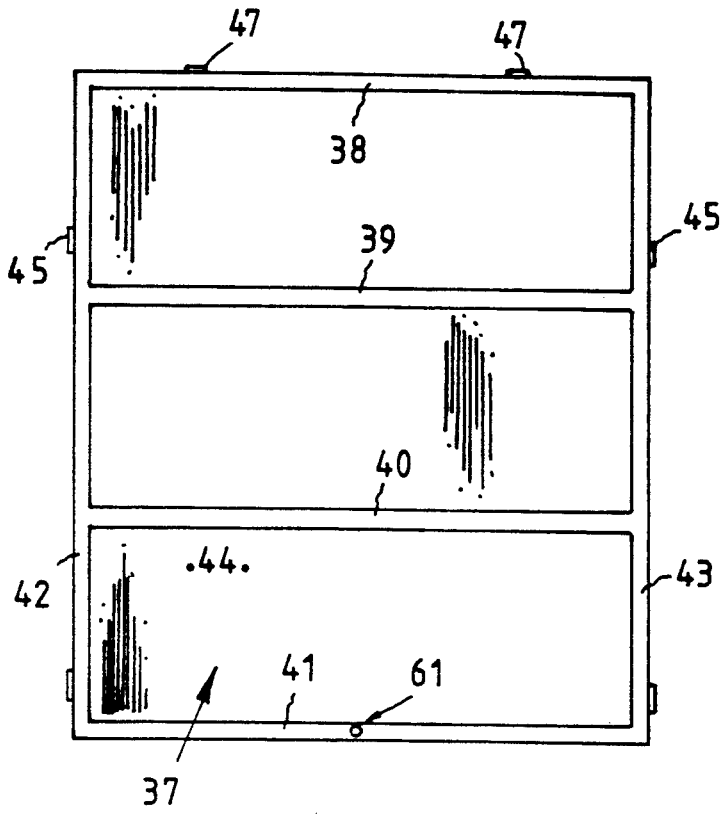
Figure 15:
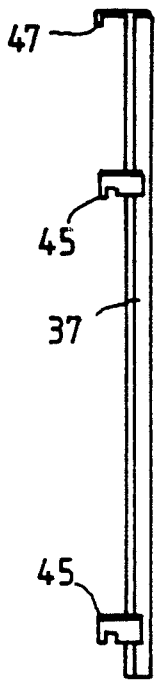
Figure 16:
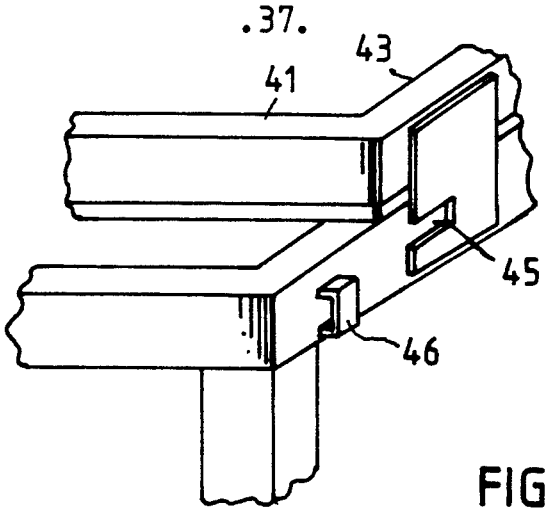
Figure 17:
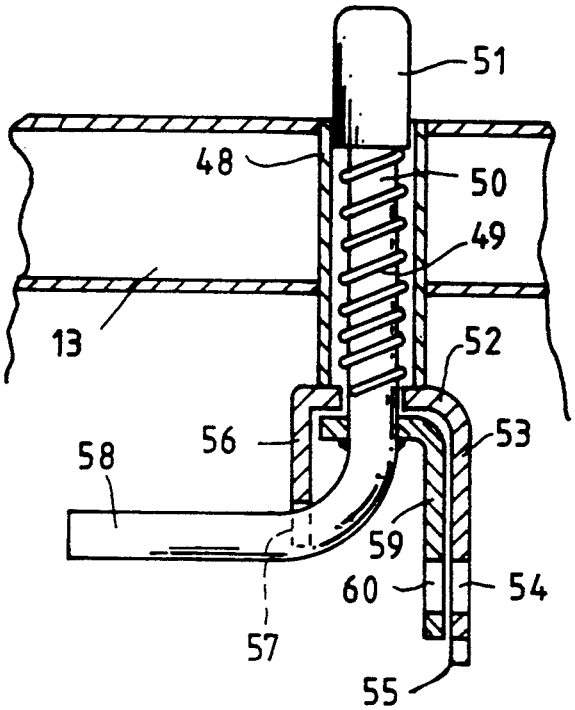
Figure 18:
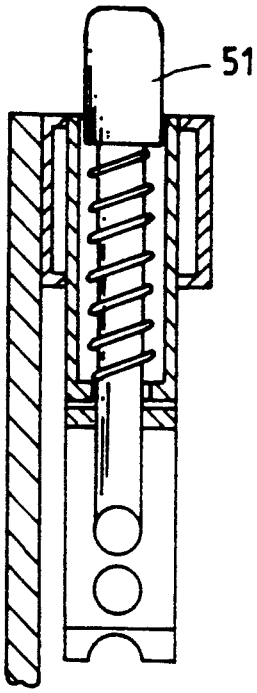
Figure 19:
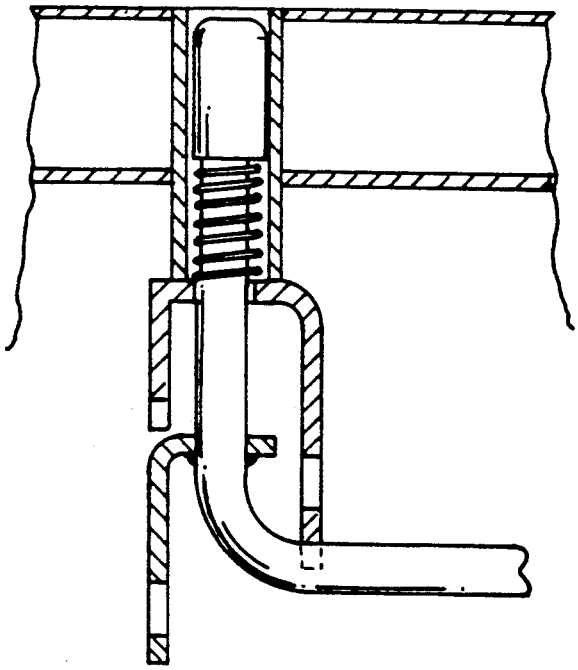
Figure 20:
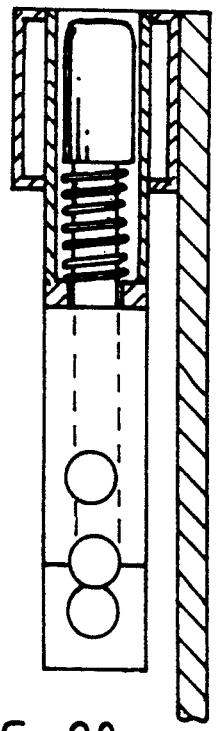
Figure 21:
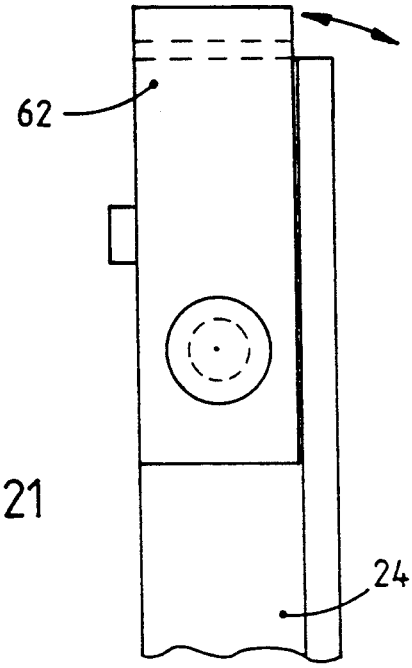
Figure 22:
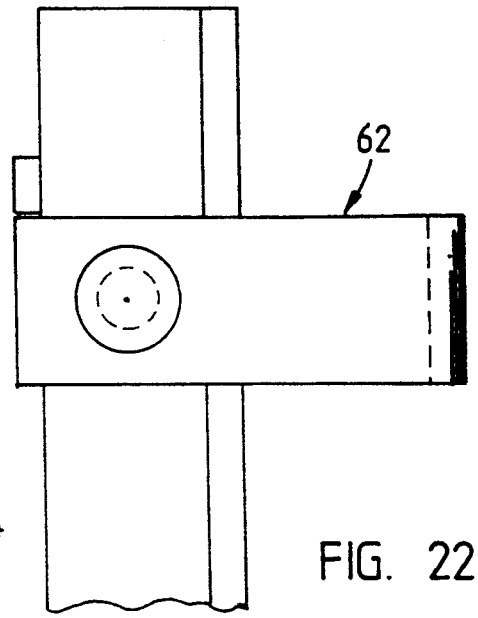
Figure 23:
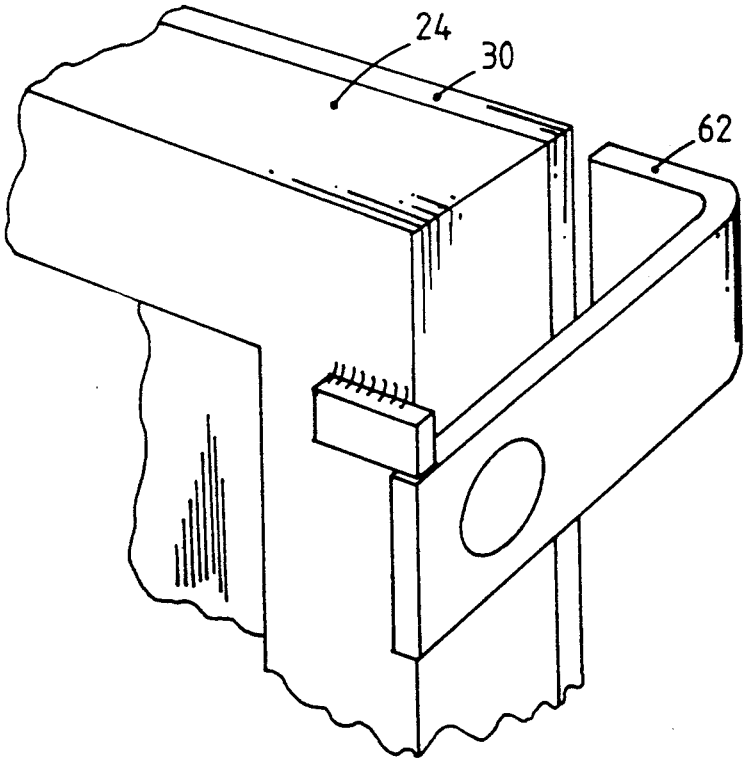
Figure 24:
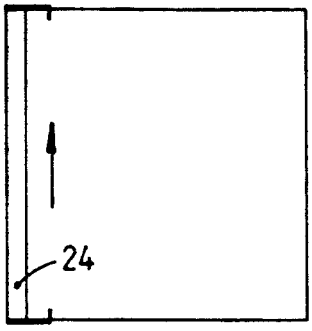
Figure 25:
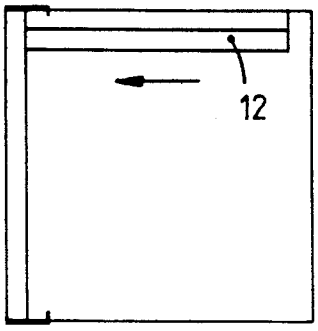
Figure 26:
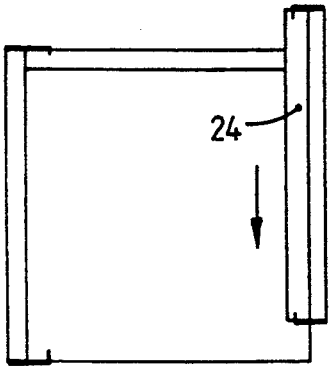
Figure 27:
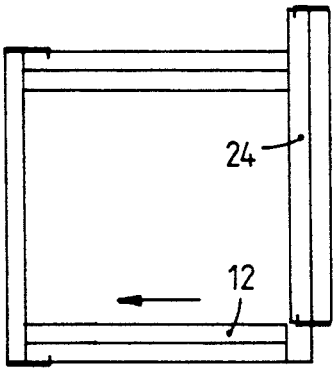
Figure 28:
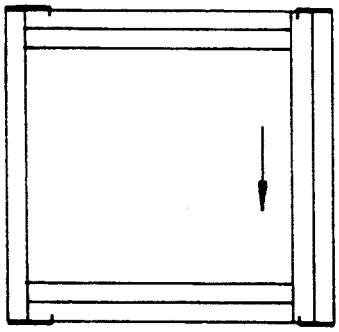
Figure 29:
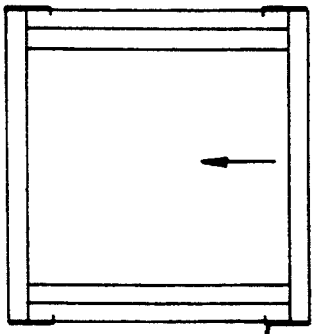
Figure 30:
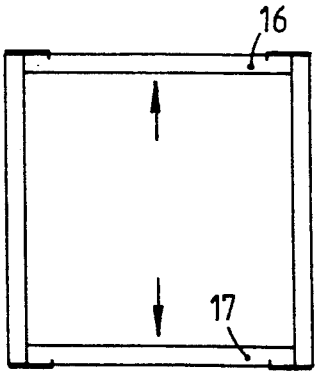
Figure 34:
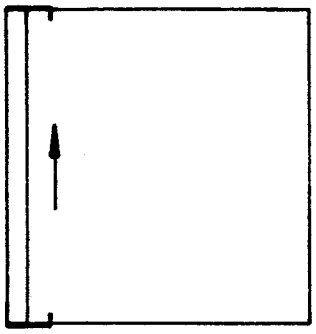
Figure 35:
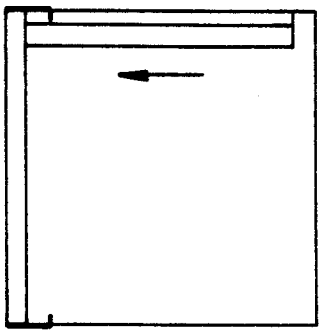
Figure 36:
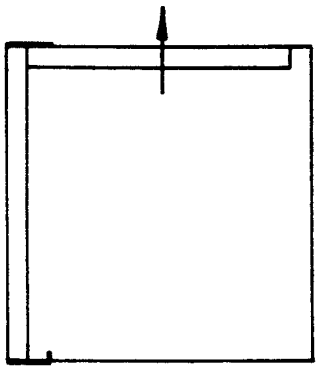
Figure 37:
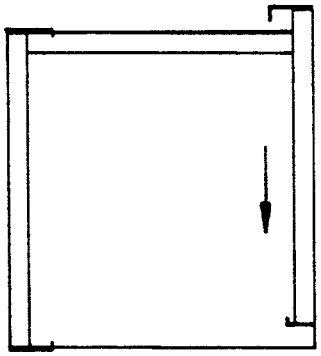
Figure 38:
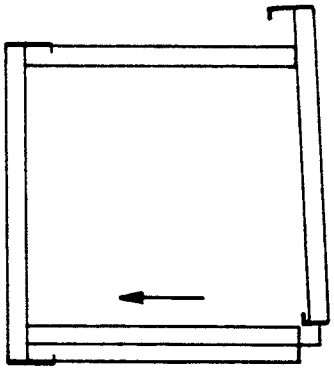
Figure 39:
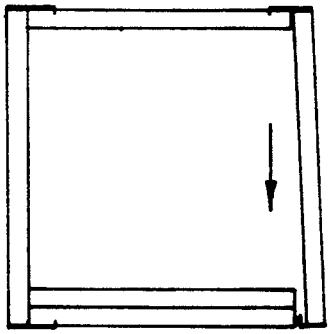
Figure 40:
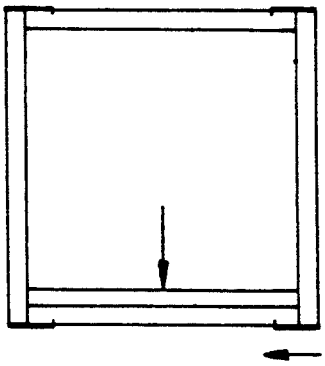

Preferred embodiments of the present invention will now be described with reference to the accompanying drawings in which:

FIG. 1 is a plan view of a base member for a container according to the invention, FIG. 2 is an elevation of one of the side panels (which form a pair) used for the container of FIG. 1, FIG. 3 is an elevation of the other of the side panels (used as a pair) for the container of FIG. 1, FIG. 4 is the first step in assembling the basic form of panels as shown in FIGS. 2 and 3 with a FIG. 1 base, FIG. 5 is the second step in the assembly procedure, FIG. 6 is the third step in the assembly procedure, FIG. 7 is the fourth and final step in the assembly procedure, FIG. 8 is the first step in assembling the alternate form panels as shown in FIGS. 2 and 3 with a FIG. 1 base, FIG. 9 is the second step in the alternate assembly procedure, FIG. 10 is the third step in the alternate assembly procedure, FIG. 11 is a fragmentary schematic elevation showing the relationship of the a panel and the base for the FIG. 10 condition, FIG. 12 is the fourth step in the alternate assembly procedure, FIG. 13 is the fifth and final step in the alternate assembly procedure, FIG. 14 is a plan view of a lid for the container comprised of basic or alternate form panels, FIG. 15 is an edge view of the lid of FIG. 14, FIG. 16 is a fragmentary corner view of a lid to panel interconnection, FIG. 17 is a sectional elevation of a portion of a panel fitted with a lid retaining bolt assembly where the bolt is in the extended condition, FIG. 18 is a side view of bolt assembly of FIG. 17, FIG. 19 is a view similar to FIG. 17 with the bolt in the retracted position, FIG. 20 is a view similar to that of FIG. 18 with the bolt in the retracted condition, FIG. 21 is a fragmentary end view of a third form of panel (of the FIG. 3 form) fitted with a retractable lock for engagement with an adjacent panel (of the FIG. 2 form) in a container according to the invention, where the lock is in the retracted condition, FIG. 22 is a view similar to FIG. 21 where the lock is in the unretracted condition, FIG. 23 is a fragmentary perspective view of the lock in the FIG. 22 condition, FIG. 24 is the first step in assembling the FIG. 3 panel as modified as shown in FIG. 21 with FIG. 2 panels on a base according to FIG. 1, FIG. 25 is the second step in the assembly procedure using the FIG. 21 panel, FIG. 26 is the third step in the assembly procedure using the FIG. 21 panel, FIG. 27 is the fourth step in the assembly procedure using the FIG. 21 panel, FIG. 28 is the fifth step in the assembly procedure using the FIG. 21 panel, FIG. 29 is the sixth step in the assembly procedure using the FIG. 21 panel FIG. 30 is the seventh and final step in the assembly procedure using the FIG. 21 panel, FIG. 31 is a fragmentary end view of a fourth form of panel (of the FIG. 3 form) fitted with an alternate form of retractable lock for engagement with an adjacent panel (of the FIG. 2 form) in a container according to the invention, where the lock is in the retracted condition, FIG. 32 is a view similar to FIG. 31 where the lock is in the unretracted condition, FIG. 33 is a fragmentary perspective view of the lock in the FIG. 32 condition, FIG. 34 is the first step in assembling the FIG. 3 panel as modified as shown in FIG. 31 with FIG. 2 panels on a base according to FIG. 1, FIG. 35 is the second step in the assembly procedure using the FIG. 31 panel, FIG. 36 is the third step in the assembly procedure using the FIG. 31 panel, FIG. 37 is the fourth step in the assembly procedure using the FIG. 31 panel, FIG. 38 is the fifth step in the assembly procedure using the FIG. 31 panel, FIG. 39 is the sixth step in the assembly procedure using the FIG. 31 panel and FIG. 40 is the seventh and final step in the assembly procedure using the FIG. 31 panel.

FIG. 1 illustrates schematically a base member 1 with four sides 2,3,4,5 and along each side 2 to 5 there is an upstanding flanges 6,7,8,9 respectively. It is to be noted that the flanges 6 to 9 terminate short of the ends of the sides to provide notches 10.

Adjacent each flange and inwards therefrom there is a pair of slots 11. The slots provide anchorage means for cleats whereby wall panels are mountable on the base 1.

FIG. 2 is illustrated a first and basic form of wall panel which is identified generally as 12. This form of wall panel will hereinafter be called a locking panel. There are two such locking panels in each enclosure to be formed on the base 1. The locking panel 12 in a commercial and presently preferred form comprises a top rail 13, a bottom rail 14, an intermediate rail 15 and uprights 16 and 17 joining the rails 13,14,15, where the rails and uprights are square tube and they are welded together to form a rigid frame. There is liner sheet 18 of plastic or plywood or the like fixed to the inner face of the frame.

There are four bolt assemblies 19 on each locking panel where each bolt assembly comprises a sleeve 20 fixed to the upright, a bolt body 21 rotatable and axially slideable in the sleeve, a handle 22 on one end of the bolt body 21 and a bolt head 23 at the other end of the bolt body 21. The bolt head 23 had a specific form to be described later.

FIG. 3 illustrates another basic form of wall panel 24, hereinafter called a locked panel. There are two locked panels 24 to each enclosure and each is similarly constructed to the locking panel just described with a top rail 25, a bottom rail 26, an intermediate rail 27 and uprights 28 and 29 joining the rails 25,26,27, where the rails and uprights are square tube and they are welded together to form a rigid frame. There is liner sheet 30 of plastic or plywood or the like fixed to the inner face of the frame. There are slots 31 in the uprights 28 and 29 with openings in the overlying liner sheet 30 to allow the heads 23 of the locking bolts to enter the slots 31 thereby to lock the four enclosure forming panels together in opposed pairs of like form.

The locking and locked panels 12,24 have cleats generally indicated 32 comprised of a body 33 and a hook leg 34. The cleats 32 are for hooking engagement in the slots 11 of the base member 1.

In a typical hooking arrangement the locking and locked panels 12,24 are sequentially mounted on the base member 1. The mounting procedure is illustrated in FIGS. 4 to 7 where the first panel to be mounted on the base member 1 is a locking panel 12. To mount it the hook legs 34 are inserted vertically into the slots 11 adjacent the flange 9 and the panel is moved in the direction of the arrow in FIG. 4 to engage the hook legs 34 under the base member 1 at the lower ends of the slots 11 (as shown in FIG. 1) and in order to do this the bottom rail 14 of the locking panel must pass through the notch 10 indicated at the top of FIG. 4.

The Next panel to be mounted is a locked panel 24. Referring now to FIG. 5, the hook legs 34 of the panel 24 are inserted vertically in the slots 11 adjacent the flange 6. The panel 24 is moved in the direction of the arrow in FIG. 5 to engage the hook legs 34 under the ends of the slots 11 and again in order to accomplish this the bottom rail 26 of the locked panel 24 must pass through the notch 10 indicated in FIG. 5. It will be noted that because the locked panel 24 is wider than the locking panel 12 the end of the locking panels 12 will be covered thereby allowing the bolt head 23 to be entered into the slots 31 in the upright 28 of the locked panel 24. The bolt is then rotated to engage the bolt head 34 against the inner face of the tube forming the upright 28. In order to achieve a firm lock and pull the uprights 17 and 28 of the panels 12 and 24 firmly together the inner face of the bolt head 34 is angled so that rotation of the bolt will effect a cam lock function against the inner face of the tube forming the upright 28.

The foregoing is followed by the mounting of a second locking panel 12 as shown in FIG. 6. The procedure as before is followed including the engagement of the bolt head on the second locking panel in the slots of the mounted locked panel. In this way the uprights 16 and 29 are locked in abutting relationship.

The last panel to be mounted is a second locked panel 24, as is illustrated in FIG. 7.

It will be noted that in the assembled condition the four panels are interlocked by the bolts 19. They are all interlocked with the base 1 through the cleats 32. They are laterally supported at their bottoms by the flanges 6,7,8,9 so that internal spreading forces applied to the panels will be resisted by the flanges and not the bodies 33 of the cleats 32. The fit of the cleats in the slots 11 can be closely toleranced because the material of manufacture in the described arrangement is metal, unlike the situation with known arrangements where the cleats had to have very liberal tolerances because of the wide variations in the sizes of the pallet battens with which the cleats had to co-operate.

A lid of anyone of several possible forms can be mounted on the enclosure but preferably the lid has downturned flanges (or equivalent features) to embrace a narrow zone around the tops of the panels to hold the enclosure integral at the top. This is a safety device so that even if the bolt assemblies 19 were undone the panels could not be moved to disengage the hooks 32 from the base member slots 11. A typical lid arrangement will be described later.

It is to be noted that the base member 1 can be part of a pallet or adapted to be fixed to a pallet or like undermember. In a further variation the slots 11 can be provided in members fixed to a pallet thereby enabling a conventional pallet to be converted to the form of the present invention.

In a variation to the above described locked and locking panels security pegs 35 are provided on the uprights 16 and 17 of the locking panels with the pegs 35 in the plane of the locking panel. The uprights 28,29 of the locked panel are provided with holes 36 to receive the pegs 35. The pegs 35 and the holes 36 are shown in phantom outline in FIGS. 2 and 3. In such an arrangement the lower of the bolt assemblies 19 could be omitted if desired.

In an assembly sequence for this arrangement reference is now made to FIGS. 8 to 14.

In FIG. 8 a locked panel 24 is mounted as hereinbefore described by vertical engagement of cleat locking legs in the slots 11 and planar movement of the panel 24. This is followed as shown in FIG. 9 by the mounting of a locking panel 12 where the panel is entered in the direction of the arrow and the peg 35 of the locking panel is entered into the hole 36 of the mounted locked panel 24. The locking bolt assembly or assemblies are then activated to join the uprights 17 and 28 of the mounted panels 12 and 24 together.

FIG. 10 illustrates the mounting of the next locked panel 24 and in this regard reference is also made to FIG. 11 which is an end view. It will be seen in FIGS. 10 and 11 that the panel 24 is not vertical but is angled outwardly at the top which is possible even though there are small clearances between the cleat bodies 33 and the slots 11 and between the bottom rail 26 of the panel 24 and the adjacent base member flange 9. In this way the panel 24 can be slid by the outwardly projecting peg 35 at the free end of the panel 12 when this required. It is to be noted that at this stage the panel 24 is not moved to fully engage the cleats with the base member slots.

The remaining locking panel is then mounted in the manner which is now well understood as shown in FIG. 12 and the panel to panel peg in hole engagement and the locking bolt assembly activation is performed at the corner where the uprights 16 and 29 abut.

The next and final step is to move the mounted but uncoupled locked panel 24 in the direction of the arrow in FIG. 13 whilst still inclined. When the hooked ends of the cleats are fully engaged the pegs 35 of the free ends of the panels 12 will be aligned with the holes 36 in the uprights of the last panel 24. The panel is then moved to the vertical and the pegs 35 will engage in the holes 36 and the locking bolt assemblies can be activated to couple the uprights 17,28 and 16,29.

The final step is to mount the lid on the assembly of panels. The lid can have any one of several forms. For example, a suitable lid would be as illustrated in FIGS. 14 to 16. In FIG. 14 the lid 37 is again a frame of tubes 38,39,40,41 joined by ends 42,43 with a liner panels 44. On the ends 42,43 there are hooks 45 which engage in a sliding action in saddles 46 on the top rails 25 of the locked panels 24, as best seen in FIG. 16. At the same time hooks 47 on the member 38 of the lid 37 will be engaged under the top rail 13 of one of the locking panels 12. In order to retain the lid 37 in place a suitable lock is used. If desired the lock can also be used in place of the hooks 47.

A typical lock as has been developed as part of the present invention is illustrated in FIGS. 17 to 20. In those Figs. there is shown a sleeve 48 fixed in the top rail 13 and housing a compression spring 49. Within the spring there is a bolt member 50 with an enlarged head 51 and the spring 49 is trapped between the head 51 and a plate 52 to bias the bolt 50 upwardly. The plate 52 has a first wing 53 with a hole 54 therethrough and a notch 55 at its lower end and a parallel short wing 56 with a notch 57 in its end. The bolt 50 has a handle part 58 and a leg 59 also with a hole 60 therethrough.

As shown in FIG. 17 the bolt is extended into a locking position and the handle 58 is engaged in the notch 57. The holes 54 and 60 are aligned allowing a padlock or wire seal or the like to be applied to prevent accidental or unauthorized with withdrawal of the bolt.

The operations positions of the bolt 50 can be readily ascertained from the FIGS. 17 to 20. The bolt head 51 is for engagement in a hole 61 in the lid member bar 41.

In an alterative arrangement for the peg and hole system 35,36, FIGS. 21 to 23 provide pivoted hooked bars 62 on the uprights 28,29 of the locked panel 24. In an assembly procedure for this arrangement, see FIGS. 24 to 30. In FIG. 24 a locked panel 24 is mounted as previously described. In FIG. 25 a lockable panel 12 is mounted as previously described and in allowed to be inclined inwardly, rather than outwardly as described with reference to FIGS. 10 and 11. The second locked panel 24 is then partly mounted on the base 1, FIG. 26, as with the previous assembly mode it is inclined outwardly and the second panel 12 is mounted as shown in FIG. 27 so that it is inclined inwardly.

It is to be noted that the hooked bar indicated 62 is swung up to allow the final positioning of the panel 24 as shown in FIG. 28 whilst it is still inclined. This allows the panel 24 to pass by the end of the second of the panels 12, as shown in FIG. 28. In FIG. 29 the hooked bar 62 has been swung down and the tiled panel 24 is made vertical followed by the making vertical of the panels 12, see FIG. 30. This engages the hooked ends of the bars 62 around the uprights 16–17 of the panels 12. Naturally the bolt assemblies 19 would be engaged sequentially as the assembly takes place to maintain the enclosure in the assembled condition.

In yet another arrangement, as shown in FIGS. 31 to 33 the pivoted hooked bars are replaced by slideable hooked bars. The principles involved are basically the same as those of the pivoted bar arrangement and the FIGS. 34 to 40 show the assembly procedure which very similar to the procedure of FIGS. 24 to 30.

I claim:

1. A collapsible container for the carriage of a liquid in a plastic liner bag, said collapsible container comprising:

a base of rectangular form having an uninterrupted support surface;

retaining flanges upstanding from said support surface and extending along each side of said base and terminating short of each corner of said base;

two pairs of rectangular wall panels, each of said wall panels having a top edge and a bottom edge and two side edges and an uninterrupted innerside surface with the height of all of said panels between the top edge and the bottom edge being substantially the same and with side-edge to side-edge width of said panels of a first pair of said two pairs being the same and greater than a common width of said panels of a second pair of said two pairs;

mounting hooks on the bottom edge of each of said panels with said mounting hooks being spaced laterally outward from the innerside surface of said panel, each of said mounting hooks having a body part and an elongated lateral leg, said body parts of said mounting hooks of each of said panels extending away from the bottom edge of said panel with the elongated lateral legs on said body parts pointing in a common direction and in a common plane substantially parallel to the plane of the innerside surface of said panel and being spaced from said bottom edge of said panel by a distance substantially equal to the thickness of said base, said base having slot apertures positioned inwardly of and adjacent to said flanges, said slot apertures having a length for permitting said mounting hooks to pass therethrough so that said elongated lateral legs are able to be hooked under said base adjacent ends of the slot apertures as a consequence of lateral movement of said panel relative to said base;

releasable interconnecting means at the side edges of each of said panels for locking together adjacent corners of said panels mounted on said base for forming a rectangular enclosure having the side edges of said panels which are narrower in an abutting relationship with the innerside surfaces of said panels which are wider.

2. The collapsible container according to claim 1, wherein said interconnecting means includes bolts slidably and rotatably mounted on the narrower of said panels with heads on said bolts for entering into bolt head apertures through the innerside surfaces of the wider of said panels and into a frame of the panel, said heads including lugs, which when said bolts are rotated, bear on inner surfaces of the frame of said panel for drawing the edge of the panel having the bolt into an abutting relationship with the innerside face of said panel with the bolt head apertures.

3. The collapsible container according to claim 1, further comprising aligning means for preventing a spreading apart of upper edges of said panels of narrower width when said releasable interconnecting means is not engaged.

4. The collapsible container according to claim 3, wherein said aligning means includes pins extending outwardly from the side edges of the narrower of said panels and lying in a plane parallel to the innerside surface of said panel with narrower width, and holes through the innerside surface of the width of said panels.

5. The collapsible container according to claim 3, wherein said aligning means includes retractable members on the side edges of the wider of said panels with limbs extending laterally from the innerside surface, the wider of said panels to be engaged by a front face of said panel of narrower width.

6. The collapsible container according to claim 5, wherein said retractable members are retractable by pivoting.

7. The collapsible container according to claim 5, wherein said retractable members are retractable by sliding.

8. The collapsible container according to claim 1, further comprising a lid having a plurality of hook lug means for slidable engagement with loops at the top edges of a pair of opposed panels.

9. The collapsible container according to claim 8, further comprising a releasable slide bolt locking means engageable in an aperture in said lid for releasably securing said lid against disengagement of said hooked lug means and said loops.

* * * * *